United States Patent [19]

Ariga et al.

[11] 4,408,095

[45] Oct. 4, 1983

[54] ACOUSTIC APPARATUS

[75] Inventors: Shoji Ariga; Tadashi Tomita, both of Toda, Japan

[73] Assignee: Clarion Co., Ltd., Tokyo, Japan

[21] Appl. No.: 239,877

[22] Filed: Mar. 2, 1981

[30] Foreign Application Priority Data

Mar. 4, 1980 [JP] Japan ..... 55-27944[U]

[51] Int. Cl.[3] ..... H04H 5/00

[52] U.S. Cl. ..... 381/24; 381/27

[58] Field of Search ..... 179/1 G, 1 GA, 1 E; 181/155

[56] References Cited

U.S. PATENT DOCUMENTS

| | | | |
|---|---|---|---|
| 3,094,587 | 6/1963 | Dow | 179/1 G |
| 3,397,286 | 8/1968 | Prewitt et al. | 179/1 G |
| 3,944,748 | 3/1976 | Kuhn | 179/1 G X |
| 4,230,905 | 10/1980 | Crum et al. | 179/1 GA |

OTHER PUBLICATIONS

*Stereo Catalog* 1976, Pub. Ziff-Davis, 1975, p. 116, "Ads Speaker Systems"-2000 and Braun.

*Stereo Catalog* 1976, Pub. Ziff-Davis, 1975, p. 128, "Infinity Servo-Statik Speaker Sys."

Jensen Sound Laboratories Advertisement in "Stereo Review", May 1978.

*Primary Examiner*—R. J. Hickey

*Attorney, Agent, or Firm*—Flynn, Thiel, Boutell & Tanis

[57] ABSTRACT

An acoustic apparatus comprised of a means for extracting middle and high frequency components from left- and right-channel signals through respective high-pass filters to reproduce the components, and a means for mixing left- and right-channel signals and extracting a low frequency component through a low-pass filter to reproduce the component, wherein the reproduction power of the middle and high frequency component is set below the reproduction power of the low frequency component.

4 Claims, 1 Drawing Figure

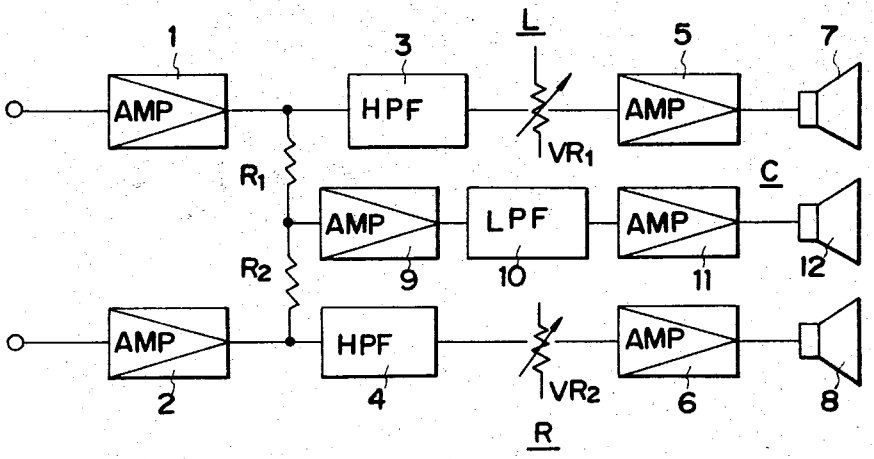
AMP
1
HPF
3
L
VR1
AMP
5
7
R1
R2
AMP
9
LPF
10
AMP
11
C
12
AMP
2
HPF
4
VR2
R
AMP
6
8

ACOUSTIC APPARATUS

BACKGROUND OF THE INVENTION

1. Field of the Invention

This invention relates to an acoustic apparatus, and more particularly to an improvement in a car-acoustic apparatus of three dimension stereo reproducing system.

2. Description of the Prior Art

The car-acoustic apparatus has been markedly improved to have a high power and high performance so as to reproduce better sound in a living space peculiar to a car and filled with noises generated by the car.

However, since a sound field in the car is closed and masking is caused by various noises, it has been difficult to obtain desired effects. Even if a music is reproduced with high fidelity from loudspeakers, the music is masked by noises such as an engine noise etc. on the way from the speakers to a listener. Thus, it is practically impossible to listen the music under desired conditions because of mixing of the noises with the music. In especial, since the car noises are in a low frequency band, the listener must listen the music without low-frequency components.

SUMMARY OF THE INVENTION

It is therefore an object of the present invention to provide an acoustic apparatus which is capable of obviating the disadvantage of the conventional car-acoustic apparatus.

In accordance with the present invention, there is provided an acoustic apparatus which comprises:

a left-channel reproducing means to extract middle and high frequency components from a left-channel signal for reproducing said components;

a right-channel reproducing means to extract middle and high frequency components from a right-channel signal for reproducing said components; and an intermediate-channel reproducing means for mixing the left- and right-channel signals and extracting a low frequency component from the mixed signals;

a reproduction power of the middle and high frequency components outputted from the left- and right-channel reproducing means being set lower than a reproduction power of the low frequency component outputted from the intermediate channel reproducing means.

BRIEF DESCRIPTION OF THE DRAWING

FIGURE is a block diagram of one embodiment of the present invention.

DESCRIPTION OF THE EMBODIMENT

Referring now to the drawing, there is illustrated an embodiment of the present invention. L is a left-channel reproducing means, R is a right-channel reproducing means, C is an intermediate-channel reproducing means, 1 and 2 are buffer amplifiers, 3 and 4 are high-pass filters, 5 and 6 are power amplifiers, 7 and 8 are loudspeakers, and $VR_1$ and $VR_2$ are gain adjusting variable resistors. 9 is an amplifier, 10 is a low-pass filter, 11 is a power amplifier and 12 is a low-frequency loudspeaker.

The buffer amplifiers 1 and 2 effect impedance change of the left- and right-channel reproducing means to prevent possible change of cut-off frequencies of the high-pass filters 3 and 4 due to an influence of signal source impedances coupled to input terminals $I_R$ and $I_L$. Signals applied to the left- and right-channel reproducing means are supplied to and mixed in the amplifier 9 through resistors $R_1$ and $R_2$ to invert phases without deteriorating stereo channel separation. In this case, the low-pass filter and the high-pass filters are so formed that selection of corner frequencies may be effected simply by changing resistances so that the costs of the filters can be curtailed. The variable resistors $VR_1$ and $VR_2$ are used to balance the output from the high-pass filters with the output from the low-pass filter.

Thus, only a low-frequency component providing little sense of direction is taken from the left- and right-channels so as to allow it to be reproduced from the low-frequency loudspeaker, i.e., woofer, and the low-frequency component is powered up by the amplifier 11 to reproduce auditorily amended original sound field. The problem caused due to masking of the low-frequency sound can thus be solved. At this time, if the middle and high-frequency components are also powered up as the low-frequency component is powered up, there is provided no desired effect and only the existing sound field is powered up. Therefore, the power of the middle and high-frequency components is suppressed to below, for example, $\frac{1}{3}$ of the power of the low-frequency component to provide auditorily balanced reproduction.

The low-frequency component provides no sense of direction as described above, but a sound image is locatable in the living space peculiar to the car, so that the low-frequency loudspeaker 12 is preferably located centrally between the tweeters (loudspeakers 7 and 8). When the sound field is controlled by variable resistors $VR_1$ and $VR_2$ of the respective tweeters, desired sound can be easily provided according to the acoustic space.

As apparent from the above description, according to the present invention, the left- and right-channel power amplifiers may be of small power as compared with that of the low-frequency component, so that not only the safety on the car is increased but the cost can be reduced. In addition, the music can be heard in a balanced state and reproduction of the original sound field can be obtained. Although the high-frequency component has a high directivity and is easy to attenuate, the power thereof is suppressed low as described above, so that it does not strike the listener's ears. And, the power of the low-frequency component surpasses the noises such as the engine noise etc., the music can be heard naturally without causing feeling of fatique.

Furthermore, since frequency division is carried out by filters, loudspeaker used in other stereo reproduction systems can be used here, as some are the middle and high frequency loudspeakers of the present apparatus.

Moreover, when the type of the car to which the apparatus of the present invention is applied is known, the cut-off frequencies of the filters may suitably be determined on the analysis of the characteristic of the car to omit the selecting operation of the filters.

We claim:

1. An acoustic apparatus which comprises:

a left-channel reproducing means including a high-pass filter for outputting middle and high frequency components from a left-channel signal;

a left-channel speaker driven by said left-channel reproducing means for reproducing said left-channel middle and high frequency components;

a right-channel reproducing means including a high-pass filter for outputting middle and high frequency components from a right-channel signal;

a right-channel speaker driven by said right-channel reproducing means for reproducing said right-channel middle and high frequency components;

in intermediate-channel reproducing means including a mixing circuit for mixing said left- and right-channel signals and a low-pass filter for outputting low-frequency component from the mixed left- and right-channel signal; and a low-frequency speaker driven by said intermediate-channel reproducing means for reproducing said mixed left- and right-channel low-frequency component;

the reproduction power of the middle and high frequency components outputted from the left- and right-channel reproducing means being set lower than the reproduction power of the low frequency component outputted from the intermediate-channel reproducing means, wherein each of the left- and right-channel reproducing means includes buffer amplifiers before and after said high-pass filter, respectively.

2. An acoustic apparatus according to claim 1, wherein said reproduction power of the middle and high frequency components outputted by the left- and right-channel reproducing means is set to be below about one-third of that of the low frequency component outputted from the intermediate-channel reproducing means.

3. An acoustic apparatus according to claim 1, wherein the left- and right-channel reproducing means and the intermediate-channel reproducing means are provided in the living space of a car.

4. An automobile stereo reproducing system comprising:

individual left-channel and right-channel reproducing means each comprising in series connection a corresponding left-channel or right-channel stereo signal source, a buffer amplifier means for preventing possible change of cut-off frequency in subsequent high-pass filtering due to influence of impedance of the signal source for that channel, a high-pass filter for outputting only the mid and high frequency components from the output of said buffer amplifier, a relatively low powered power amplifier for amplifying said mid and high frequency output from said high-pass filter, and a mid and high frequency loud speaker driven by said relatively low powered power amplifier;

an intermediate channel reproducing means comprising a mixing circuit including a mixing amplifier, a pair of resistors respectively connected to the left-channel and right-channel reproducing means between said buffer amplifier and high-pass filter therein and further connected to a common input of said mixing amplifier, a low-pass filter driven by said mixing amplifier and for outputting only the combined low frequency components from the left-channel and right-channel signal sources, a relatively high powered power amplifier having at least three times the power output of said left-channel and right-channel power amplifiers, and a low frequency loudspeaker driven by said low frequency power amplifier, said low frequency loudspeaker being located substantially centrally between said mid and high frequency loudspeakers, the output of said low frequency power amplifier being sufficient to surpass engine and other noise associated with normal operation of the car, variable resistors respectively interposed in the left-channel reproducing means and right-channel reproducing means between the corresponding high-pass filter and power amplifier in each for limiting the output power level of the mid and high frequency power amplifier to below about one-third of the power applied to the low frequency components so as to balance the output from the high-pass filters with the output from the low-pass filter, said left- and right-channel reproducing means and intermediate-channel reproducing means, together with the loudspeakers driven thereby, being contained in the living space of a car.

* * * * *